US007886777B2

(12) United States Patent
Doyle

(10) Patent No.: US 7,886,777 B2
(45) Date of Patent: Feb. 15, 2011

(54) SAILCLOTH

(75) Inventor: Brian Patrick Doyle, Amherst, MA (US)

(73) Assignee: North Sails Group, LLC, Milford, CT (US)

( * ) Notice: Subject to any disclaimer, the term of this patent is extended or adjusted under 35 U.S.C. 154(b) by 0 days.

(21) Appl. No.: 12/277,183

(22) Filed: Nov. 24, 2008

(65) Prior Publication Data

US 2010/0126619 A1 May 27, 2010

(51) Int. Cl.
*D03D 17/00* (2006.01)
*D03D 13/00* (2006.01)
*D03D 25/00* (2006.01)

(52) U.S. Cl. ..... 139/426 R; 139/383 R; 139/384 R; 139/419; 139/420 R; 139/420 A

(58) Field of Classification Search ..... 139/383 R, 139/384 R, 419, 420 R, 426 R, 420 A, DIG. 1
See application file for complete search history.

(56) References Cited

U.S. PATENT DOCUMENTS 4,444,822 A * 4/1984 Doyle et al. ..... 428/109
4,499,842 A * 2/1985 Mahr ..... 114/102.31
4,864,953 A * 9/1989 Allsopp et al. ..... 114/102.27
4,892,780 A * 1/1990 Cochran et al. ..... 442/242
5,001,003 A * 3/1991 Mahr ..... 442/41
5,079,055 A * 1/1992 Doyle ..... 428/36.2
5,097,784 A * 3/1992 Baudet ..... 114/102.31
5,161,479 A * 11/1992 Mahr ..... 114/102.31
5,394,563 A * 3/1995 Doyle ..... 2/2.11
6,106,649 A * 8/2000 Slyne ..... 156/179
6,725,885 B2 * 4/2004 Mahr ..... 139/383 R
2002/0177377 A1 * 11/2002 Mahr ..... 442/203

FOREIGN PATENT DOCUMENTS

GB 2313607 A * 12/1997

* cited by examiner

*Primary Examiner*—Bobby H Muromoto, Jr.
(74) *Attorney, Agent, or Firm*—Foley & Lardner LLP

(57) ABSTRACT

As an example of a specific fabric, the fabric would comprise 52 yarns per inch of 350 denier polyester in the warp and 132 yarns per inch of 150 denier in the fill. Using the above density calculation, this would result in a cloth having a warp density of 973 and a fill density of 1617. When viewed at high magnification, the warp yarns (41) are relatively uncrimped as compared to the textured fill yarns (43), as illustrated by the scanning electron microscope photo shown in FIG. 5 and the densities are sufficient to provide a fabric having good stretch resistance along the bias and the warp (see e.g., FIGS. 1 and 2).

39 Claims, 5 Drawing Sheets

| Nr | Direction | 10 lbs in | Load @ 1% lbf |
|---|---|---|---|
| 1 | 45 | 8.9 | 18.3 |
| 2 | 45 Flutter | 10.0 | 16.7 |
| 3 | Fill | 1.8 | 73.7 |
| 4 | Fill Flutter | 3.0 | 66.5 |

| Nr | Direction | 10 lbs in | Load @ 1% lbf |
|---|---|---|---|
| 1 | 45 | 8.9 | 18.3 |
| 2 | 45 Flutter | 10.0 | 16.7 |
| 3 | Fill | 1.8 | 73.7 |
| 4 | Fill Flutter | 3.0 | 66.5 |

| Nr | Direction | 10 lbs in | Load @ 1% lbf |
|---|---|---|---|
| 1 | 45 | 8.3 | 18.3 |
| 2 | 45 Flutter | 10.0 | 16.0 |
| 3 | Fill | 6.5 | 23.0 |
| 4 | Fill Flutter | 9.5 | 18.7 |
| 5 | Warp | 1.7 | 78.2 |
| 6 | Warp Flutter | 2.1 | 75.4 |

SAILCLOTH

BACKGROUND

Sailcloth is typically made from a variety of materials, with one of the most common being a tightly woven cloth of polyester yarns. Sailcloth is one of the most tightly woven textiles in the world and requires extensively modified heavy looms to generate the necessary forces to attain such a dense construction. Normally, polyester sailcloth is only woven in what is known as a plain weave, in which every warp yarn passes over and under each fill yarn, with the yarns being crimped over each other. After weaving, the cloth is impregnated with a resin and heated, causing the resin to cure and also causing the polyester fabric to shrink.

The above described weaving method tends to impart certain characteristics to the cloth due to the nature of the operation itself. The warp yarns, which run in the machine on long direction tend to crimp more than the weft or fill yarns, which run in the cross machine direction. Sails formed from such cloth are made up of a number of joined panels, and it is desirable to align the yarns with less crimp along directions of maximum stress or load in the sail. This, in turn, reduces stretch, which would otherwise cause the sail to lose its ideal or designed shape when subjected to increasing wind forces.

Fill oriented cloth imposes limitations on how panels can be cut and arranged in a sail while still making efficient use of the cloth. A common design using fill oriented cloth is a so-called cross cut design, in which the seams are substantially horizontal, and the fill yarns run from the top to the bottom of the sail.

Studies of the properties of sails have demonstrated that in triangular sails, especially genoas or jibs, the main forces radiate out of the corners of the sail. See e.g., FIG. 4.

SUMMARY

Disclosed herein are methods and compositions related to woven fabrics. In some embodiments, the fabric is a woven cloth including a flat filament warp yarn and a fill yarn that includes a yarn that has been modified so that the filaments do not lie substantially parallel to one another, for example a textured yarn. In some embodiment, the woven cloth is sailcloth.

In some embodiments, the density of the warp of the as woven cloth is from about 900-1500 and the density of the fill is greater than about 1000. In other embodiments, the ratio of fill yarn weight to warp yarn weight is from about 1:1 to about 0.25:1. In still other embodiments, the warp yarns have a denier of from about 100-2000 and the fill yarns have a denier of from about 30-1000.

In some embodiments, the fabrics disclosed herein include warp yarns made of polyester, aramid, carbon, polyethylene, a thermoplastic yarn, and combinations thereof. In some embodiments, the fabrics include textured fill yarns made of thermoplastic yarn, such as polyester, and may also include a flat filament yarn.

In some embodiments, multiple, different warp and/or fill yarns may be used. For example, a fabric may include a first fill yarn and a second fill yarn. In some embodiments, the first fill yarn includes a first textured yarn, and the second fill yarn includes a second textured yarn. In other embodiments, the first fill yarn and the second fill yarn are the same; in still other embodiments, the first fill yarn and the second fill yarn are made of different material; in still other embodiments, the first fill yarn is higher denier than the second fill yarn. In yet further embodiments, a single shed comprises the first fill yarn and the second fill yarn.

The present disclosure also describes method of manufacturing a woven cloth. Such methods include providing a warp yarn and a fill yarn, wherein the warp yarn includes a flat filament yarn and the fill yarn includes a yarn that has been modified so that the filaments do not lie substantially parallel to one another, for example a textured yarn. In some embodiments, the method includes weaving the warp and fill yarns to form a cloth. In some embodiments, the cloth is woven such that the density of the warp is from about 900-1500 and the density of the fill is greater than about 1000.

The present disclosure also describes methods for manufacturing sails. In some embodiments, the method includes providing a woven cloth or a woven sailcloth including a flat filament warp yarn and a fill yarn that includes a yarn that has been modified so that the filaments do not lie substantially parallel to one another, for example a textured yarn. In some embodiments, the density of the as woven warp is from about 900-1500 and the density of the fill is greater than about 1000. In some embodiments, the warp yarn and the fill yarn comprises polyester.

In some embodiments, the method includes providing one or more panels formed from the woven cloth or the woven sailcloth, and positioning the one or more panels to form a sail. In some embodiments, the method includes positioning the panels such that the warp yarns are positioned generally parallel to, or approximately along a predicted load line of the sail.

The graph and the table indicate that the bias-cut samples (Nr 1 and Nr 2) show 1% stretch (0.16 strain in inches) at 18.3 pounds (Nr 1) and 16.7 pounds for the flutter-treated sample (Nr 2). The fill-cut samples show 1% stretch at 73.7 pounds (Nr 3) and 66.5 pounds for the flutter-treated sample (Nr 4).

Figure 1:
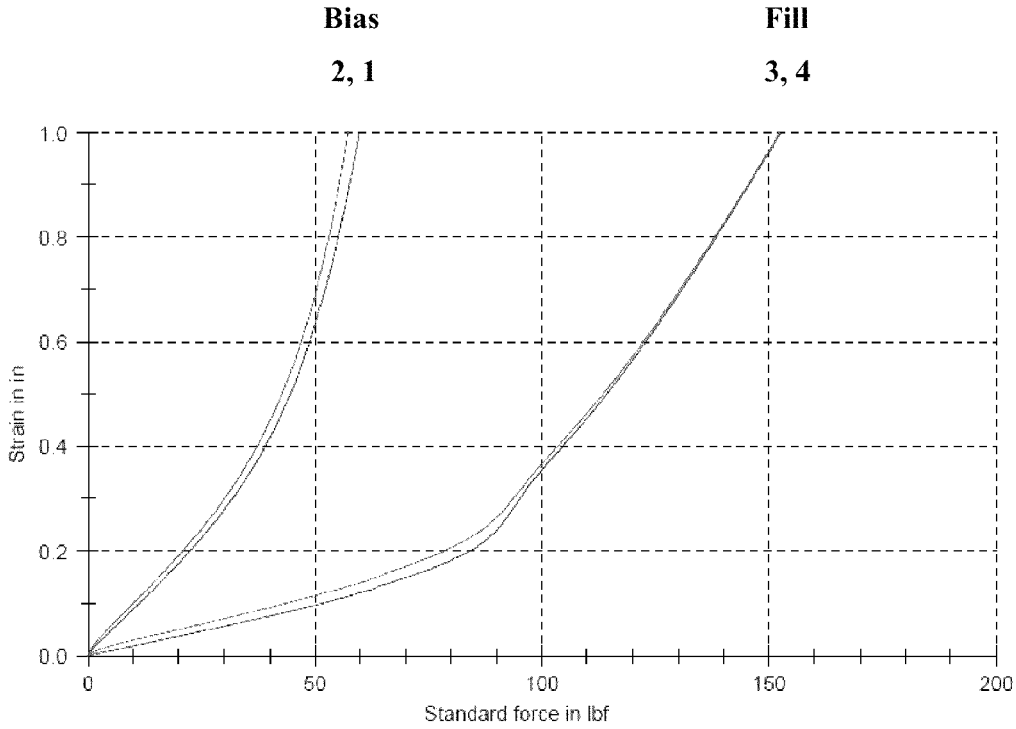
FIG. 1 includes a table and a graph showing the results of stress tests on a fill oriented sailcloth. For the fabric used in the stress test, the warp was 150 denier, with an as woven density of about 1715; the fill was about 350 denier with an as woven density of about 1122. Strips of cloth 16 inches long and 2 inch wide were cut in the fill orientation or the bias (45%) orientation. Strips were subject to a stretch test, or fluttered (whirled in a circle with one end free at 30 mph for 30 minutes. This done on a specially constructed testing machine), and then stretched.
Figure 2:
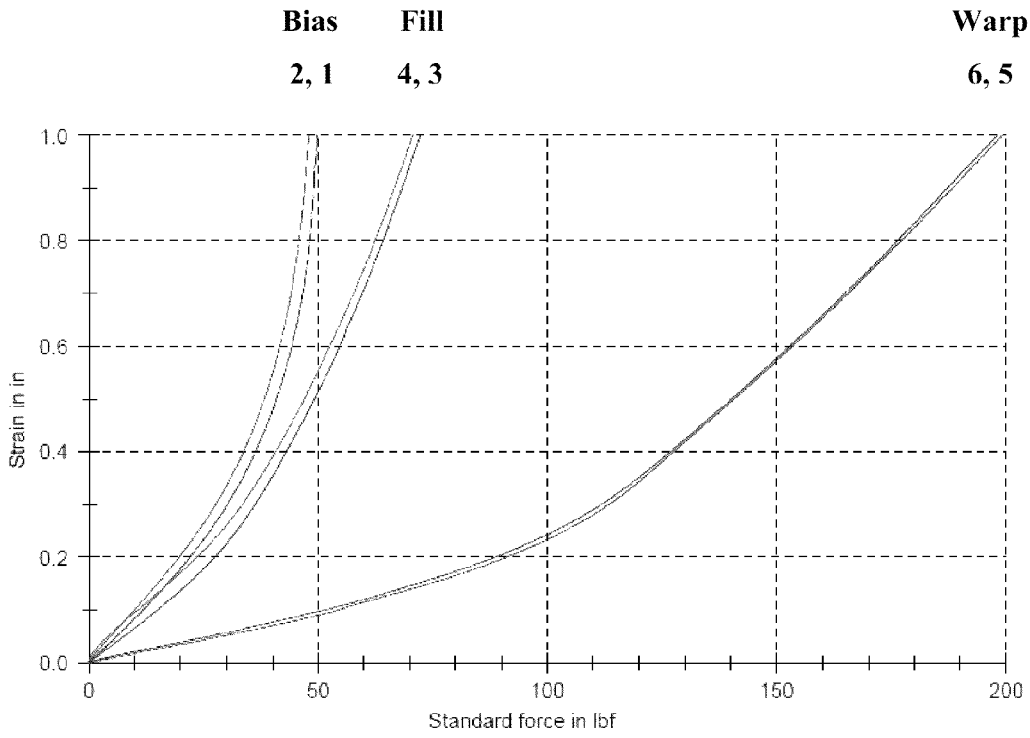

FIG. 2 includes a table and a graph showing the results of stress tests on a warp-oriented sailcloth. The warp oriented sailcloth was made of 100% polyester, flat-filament yarns in the warp orientation and 100% polyester textured yarn in the fill orientation. The warp yarns were 350 denier, with an as woven density of about 973; the fill yarns were about 150 denier with density of about 1617. The graph and the table indicate that the bias-cut samples (Nr 1 and Nr 2) show 1% stretch at approximately at 18.3 pounds for the unfluttered sample, and 16.0 pounds for the flutter-treated sample. Note that these values similar to the bias cut-samples of the fill-oriented sailcloth of FIG. 1. The warp-cut samples show 1% stretch at 78.2 and 75.4 pounds. These values are comparable, if not better, than those for the fill-cut samples of the fill-oriented sailcloth shown in FIG. 1.

Figure 3:
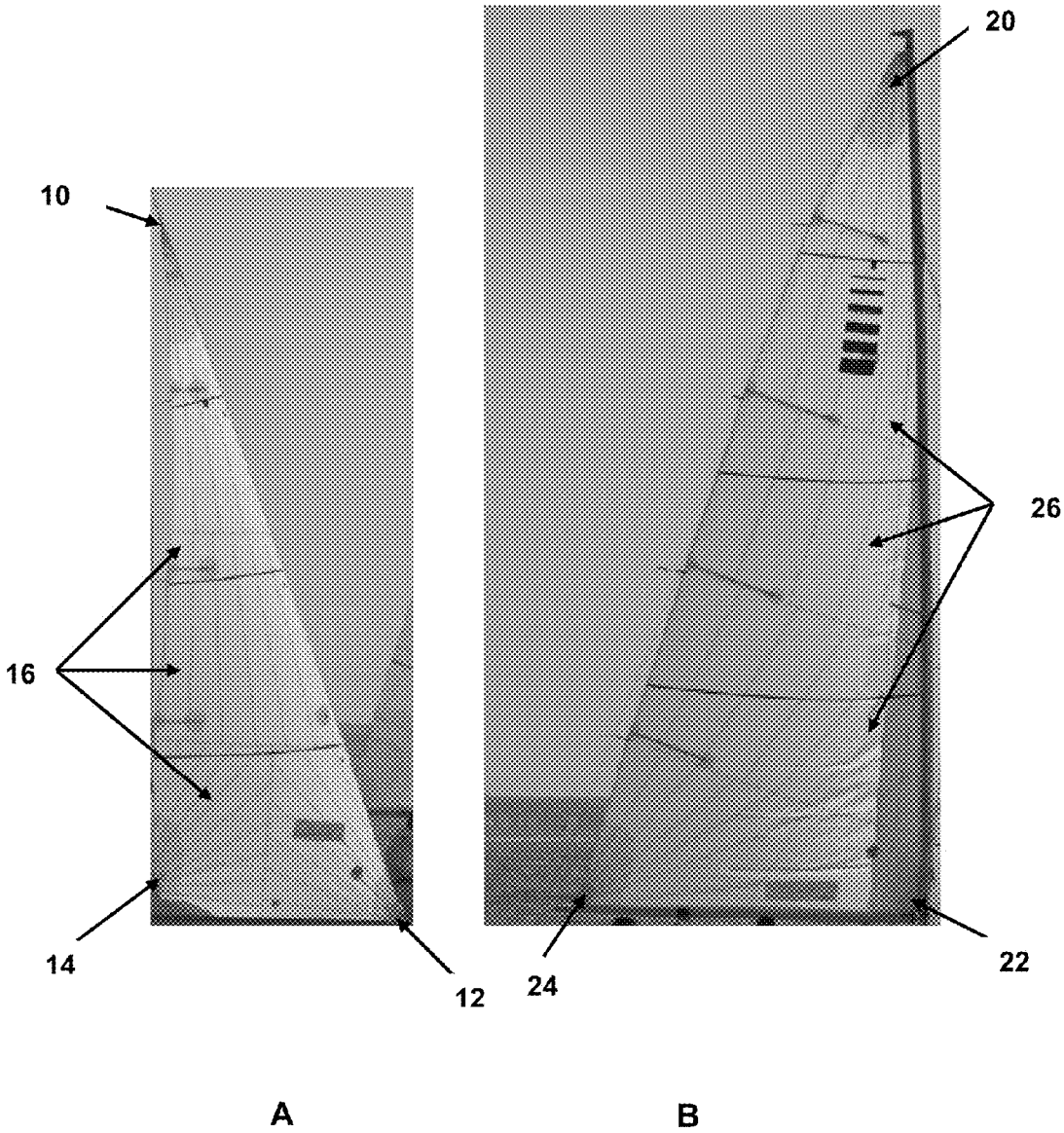

FIG. 3 shows a headsail and a mainsail made up of panels of the woven cloth described herein.

Figure 4:
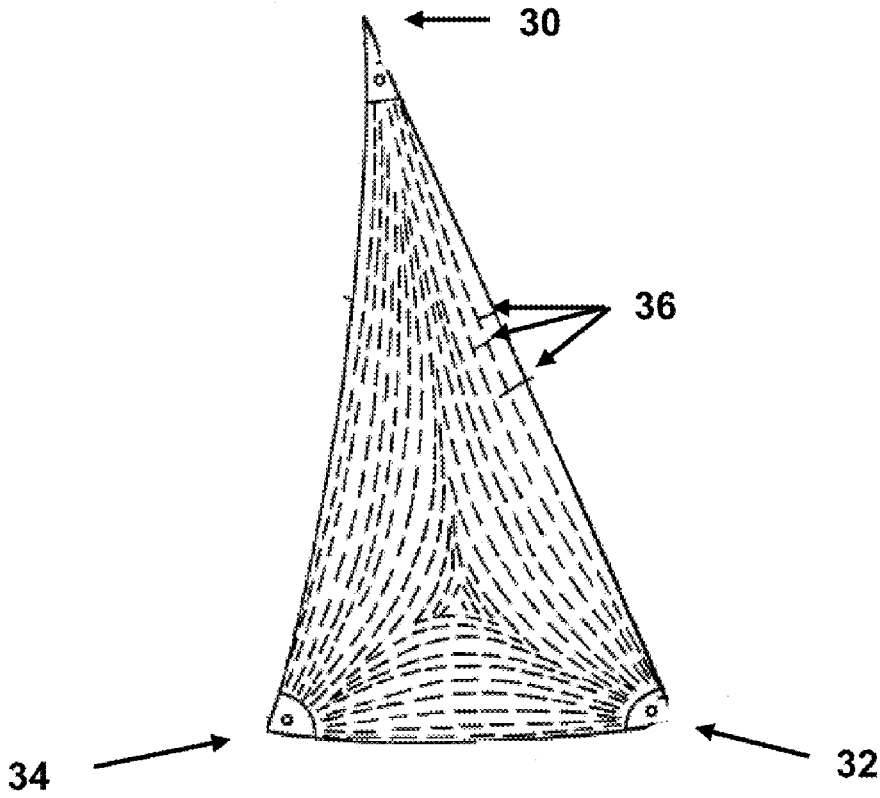

FIG. 4 is a diagram illustrating load lines or lines of force emanating from the corners of a triangular sail.

Figure 5:
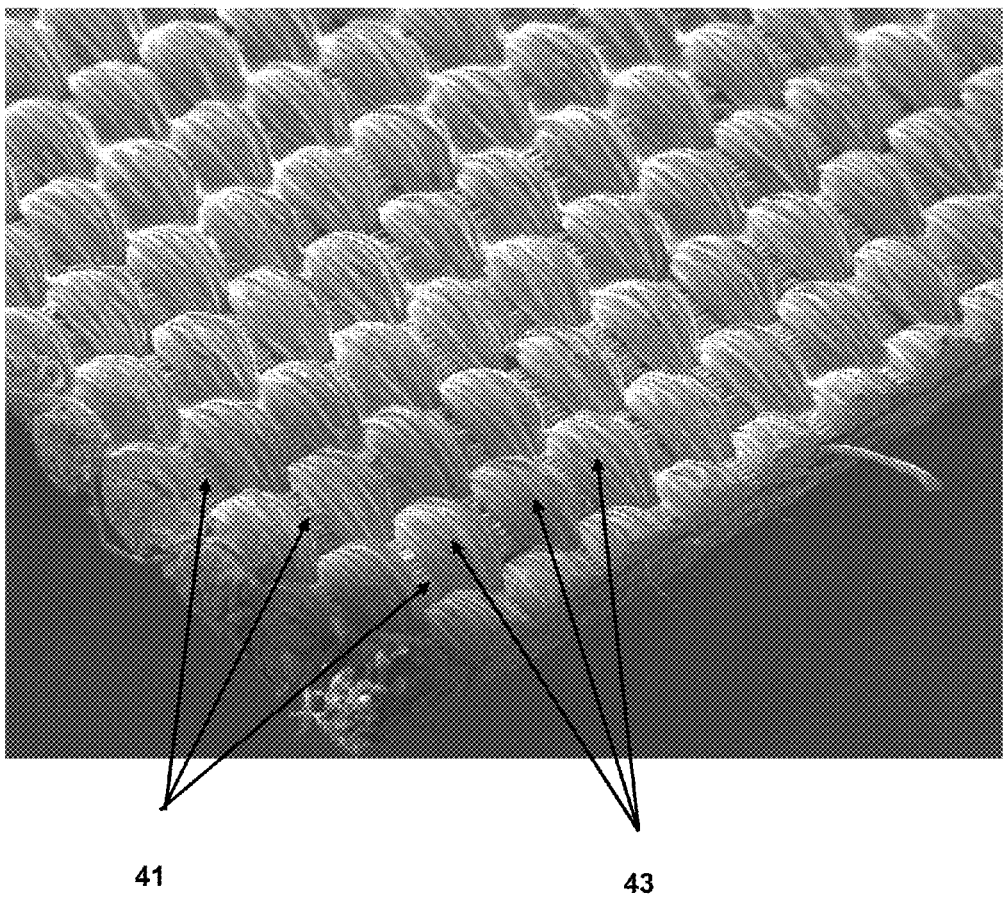

FIG. 5 is a scanning electron micrograph (SEM) of a sample of the woven fabric described herein.

DETAILED DESCRIPTION

A high-density, woven fabric comprising textured yarn is provided herein. Particularly, the fabric comprises yarns in which weave-crimp (crimp) is imparted to the fill yarns, leaving the warp yarns relatively uncrimped. This is accomplished by using textured yarn in the fill direction. The resulting cloth has more resistance to stretch in the warp orientation than in the fill orientation, and therefore provides a longer, continuous piece of fabric that can be aligned with anticipated loads or stresses. Such fabrics are useful, for example, in the manufacture of sails or architectural fabrics (e.g., awnings, tents, tension structures and the like).

The present invention is described herein using several definitions, as set forth below and throughout the application.

As used herein, unless otherwise stated, the singular forms "a," "an," and "the" includes plural reference.

As used herein, the terms cloth and fabric are used interchangeably and refer to a pliable material made usually by weaving natural or synthetic fibers and/or filaments. In some embodiments, the cloth or fabric is sailcloth.

As used herein, the term "yarn" or "yarns" means an assemblage of filaments or fibers, joined together to form a continuous strand. Non-limiting examples include materials having good tensile strength and stretch resistance. By way of example, but not by way of limitation, yarns include those composed of polyester, aramid, polyolefin, carbon, polyamids, and the like, as well as blends and composites, such as, for example, aramid blended or wrapped with polyester.

In general, yarns used in the present compositions and methods range in size from about 30 to about 2000 denier. For example, in some embodiments, the warp yarns may range in size from about 100 to about 2000 denier, from about 200 to about 1500 denier, or from about 300 to about 1000 denier. In other embodiments, fill yarns may range from about 30 to about 1000 denier, from about 50 to about 750 denier, or from about 75 to about 500 denier. In some embodiments, a desired denier is achieved by combining two yarns in the same shed. For example, if a 400 denier fill is desired, two fill yarns, each having a denier of 200, may be woven into the same shed.

As used herein, the term "density" of a fabric is determined by multiplying the square root of the yarn in denier which is a number proportional to the effective diameter of the yarn, by the yarns count per inch. Generally, the fabrics described herein have warp densities from about 900 to about 1500 and fill densities greater than about 1000. Or, more generally, the warp density will be less than the fill density.

In some embodiments, the ratio of fill yarn weight to warp yarn weight is from about 1:1 to about 0.25:1.

As an example of a specific fabric, the fabric would comprise 52 yarns per inch of 350 denier polyester in the warp and 132 yarns per inch of 150 denier in the fill. Using the above density calculation, this would result in a cloth having a warp density of 973 and a fill density of 1617. When viewed at high magnification, the warp yarns (41) are relatively uncrimped as compared to the textured fill yarns (43), as illustrated by the scanning electron microscope photo shown in FIG. 5, and the densities are sufficient to provide a fabric having good stretch resistance along the bias and the warp (see e.g., FIGS. 1 and 2).

The fabrics disclosed herein are formed by incorporating textured yarn in the fill orientation, and non-textured or flat-filament yarn in the warp orientation. Examples of flat-filament warp yarns include, but are not limited to polyester, aramid, carbon, polyethylene, nylon, polypropylene, and combinations thereof.

Non-limiting examples of textured fill yarns include thermoplastic yarns, such as polyester, polypropylene, polyester blends and nylon. In some embodiments, the fill yarns include filaments which have been modified such that they do not lie substantially parallel to one another.

In some embodiments, thermoplastic or textured yarns are incorporated into the warp along with the flat-filament yarns. In other embodiments, flat filament yarns are incorporated into the fill along with the textured yarns. For the fabrics disclosed herein, the majority of the yarns in the warp orientation are flat-filament, and the majority of yarns in the fill orientation are textured.

In further embodiments, materials such as fiberglass may be incorporated into the fabric to provide strength and rigidity for use. By way of example, but not by way of limitation, architectural fabrics may include fiberglass to provide strength and rigidity.

The fabrics disclosed herein can be formed by standard weaving methods known in the art, incorporating textured yarn in the fill orientation, and non-textured or flat-filament yarns in the warp orientation. In some embodiments, the fabrics include multiple types of warp yarns, multiple types of fill yarns, or multiple yarns per shed. For example, in some embodiments, the warp and/or the fill may be formed using yarns of different denier and/or different material.

In some embodiments, the woven fabric is sailcloth and is used to make sails. As an example of a specific sailcloth, the sailcloth is a plain weave and comprises textured polyester yarns (having a denier from about 30 to about 1000) in the fill orientation and flat-filament polyester yarn (having a denier from about 100 to about 2000) in the warp orientation. The final sailcloth has a warp density of from about 900 to about 1500 and a fill density greater than about 1000. In some embodiments, sails are made of a combination of the fabric disclosed herein, and conventional sail fabrics. In other embodiments, the sails include, as the main component, the fabrics disclosed herein.

In some embodiments, subsequent to weaving, the sailcloth is subjected to additional finishing operations. For example, the fabric is first cleaned to remove any seizing. Then the fabric is dipped into an aqueous bath of heat curable resin, such as melamine, which serves to lock the woven geometry and decrease stretch. The fabric is then dried and heat-set by passing through an oven, causing the yarns to shrink, thereby increasing density. The fabric is then calendared by passing the fabric between a pair of rolls under high pressure, with one of the rolls being heated.

After the finishing operation, the cloth may be used as such to construct a sail. Depending on size, the sail may be made of a single panel or it may be made of many panels. The panels are cut and arranged such that the uncrimped warp yarns follow the predicted major lines of stress in the sail when the sail is used (e.g., are generally parallel to the predicted load lines).

FIG. 4 provides a non-limiting illustration showing predicted load lines 36, radiating from the corners (head 30, tack, 32 and clew, 34) of a head sail. The predicted load lines 36 extend between adjacent corners of the sail; for example, lines of force or load lines radiate from the head 30 and extend to the tack 32 and clew 34. Lines of force also extend between the tack 32 and clew 34. Those skilled in the art will understand that different sails (e.g., different types of head sails and main sails) will have different predicted load line patterns, and that the predicted load line patters for a particular sail can differ under different wind conditions. Load lines for a sail of desired dimensions and use can be determined using methods known to those skilled in the art. Such method include computer programs.

FIG. 3 show two exemplary sails, a head sail 3A, and a main sail, 3B, both constructed from the woven fabric described herein. Referring to the head sail of FIG. 3A, the panels, 16 were cut and arranged such that the uncrimped warp yarns radiate from the corners of the sail, head 10, tack 12 and clew 14, generally along predicted load lines of the head sail. Similarly, as shown in FIG. 3B, the panels 26 of the main sail were cut and arranged such that, when joined together, the uncrimped warp yarns extend generally from the head 20, tack 22 and clew 24, and run generally along predicted load lines of a main sail.

What is claimed is:

1. A sailcloth comprising:

a warp yarn, wherein the warp yarn comprises a flat filament yarn; and a fill yarn woven with the warp yarn, wherein the fill yarn comprises a textured yarn;

wherein weave-crimp is imparted to the fill yarn as woven, and the warp yarn is relatively uncrimped as compared to the fill yarn in the sailcloth, and wherein texturing allows the fill yarns to be woven around the warp yarns to form weave-crimps, without imparting crimp to the warp yarns.

2. The sailcloth of claim 1, wherein the density of the warp is from about 900-1500 and the density of the fill is greater than about 1000.

3. The sailcloth of claim 1, wherein the ratio of fill yarn weight to warp yarn weight is from about 1:1 to about 0.25:1.

4. The sailcloth of claim 1, wherein the warp yarns have a denier of from about 100-2000 and the fill yarns have a denier of from about 30-1000.

5. The sailcloth of claim 1, wherein the warp yarn comprises a thermoplastic yarn.

6. The sailcloth of claim 1, wherein the warp yarn is selected from the group consisting of: polyester, aramid, carbon, polyethylene and combinations thereof.

7. The sailcloth of claim 1, wherein the warp yarn and the fill yarn comprise polyester.

8. The sailcloth of claim 1, comprising a first fill yarn and a second fill yarn; wherein the first fill yarn comprises a first textured yarn, and wherein the second fill yarn comprises a second textured yarn.

9. The sailcloth of claim 8, wherein the first fill yarn and the second fill yarn are the same.

10. The sailcloth of claim 8, wherein the first fill yarn and the second fill yarn are made of different material.

11. The sailcloth of claim 8, wherein the first fill yarn is higher denier than the second fill yarn.

12. A sail comprising the sailcloth of claim 1.

13. A sail comprising a plurality of panels, wherein the panels comprise the sailcloth of claim 1.

14. The sail of claim 13, wherein the warp yarns are positioned generally along a predicted load line of the sail.

15. The sail of claim 14, wherein the warp yarns and the fill yarns comprise polyester.

16. A method of manufacturing a sail comprising:

(a) providing a woven sailcloth comprising:

a warp yarn and a fill yarn;

wherein the warp yarn comprises a flat filament yarn and the fill yarn comprises a textured yarn, wherein weave-crimp is imparted to the fill yarn as woven, and the warp yarn is relatively uncrimped as compared to the fill yarn, and wherein texturing allows the fill yarns to be woven around the warp yarns to form weave-crimps, without imparting crimp to the warp yarns;

(b) cutting one or more panels formed from the woven cloth; and (c) positioning the one or more panels to form a sail.

17. The method of claim 16, comprising positioning the panels such that the warp yarns are positioned generally along a predicted load line of the sail.

18. The method of claim 16, wherein the density of the warp is from about 900-1500 and the density of the fill is greater than about 1000.

19. The method of claim 16, wherein the warp yarn and the fill yarn comprises polyester.

20. A sailcloth comprising:

a warp yarn and a fill yarn;

wherein the warp yarn comprises a flat filament yarn, wherein the fill yarn comprises filaments, and wherein the fill yarn has been modified so that the filaments do not lie substantially parallel to one another, wherein weave-crimp is imparted to the fill yarn as woven, and the warp yarn is relatively uncrimped as compared to the fill yarn, and wherein modification allows the fill yarns to be woven around the warp yarns to form weave-crimps, without imparting crimp to the warp yarns.

21. The sailcloth of claim 20, wherein the density of the warp is from about 900-1500 and the density of the fill is greater than about 1000.

22. A woven cloth comprising:

a warp yarn and a fill yarn;

wherein the warp yarn comprises a flat filament yarn and the fill yarn comprises a textured yarn;

wherein weave-crimp is imparted to the fill yarn as woven, and the warp yarn is relatively uncrimped as compared to the fill yarn, wherein texturing allows the fill yarns to be woven around the warp yarns to form weave-crimps, without imparting crimp to the warp yarns, and wherein the density of the warp is from about 900-1500 and the density of the fill is greater than about 1000.

23. The cloth of claim 22, wherein the ratio of fill yarn weight to warp yarn weight is from about 1:1 to about 0.25:1.

24. The cloth of claim 22, wherein the warp yarns have a denier of from about 100-2000 and the fill yarns have a denier of from about 30-1000.

25. The cloth of claim 22 wherein the warp yarn is selected from the group consisting of: polyester, aramid, carbon, polyethylene and combinations thereof.

26. The cloth of claim 22, wherein the warp yarn comprises polyester.

27. The cloth of claim 22, wherein the warp yarn comprises a thermoplastic yarn.

28. The cloth of claim 22, wherein the fill yarn comprises polyester.

29. The cloth of claim 22, wherein the fill yarn comprises a thermoplastic yarn and a flat filament yarn.

30. A method of manufacturing a woven cloth comprising:

(a) providing a warp yarn and a fill yarn, wherein the warp yarn comprises a flat filament yarn and the fill yarn comprises a textured yarn;

(b) weaving the warp and fill yarns to form a cloth, wherein the density of the warp is from about 900-1500 and the density of the fill is greater than about 1000, wherein weave-crimp is imparted to the fill yarn as woven, and the warp yarn is relatively uncrimped as compared to the fill yarn, and wherein texturing allows the fill yarns to be woven around the warp yarns to form weave-crimps, without imparting crimp to the warp yarns.

31. A woven cloth comprising:

a warp yarn and a fill yarn;

wherein the warp yarn comprises a flat filament yarn, and wherein the fill yarn comprises filaments, and wherein the fill yarn has been modified so that the filaments do not lie substantially parallel to one another;

wherein weave-crimp is imparted to the fill yarn as woven, and the warp yarn is relatively uncrimped as compared to the fill yarn, wherein the density of the warp is from about 900-1500 and the density of the fill is greater than about 1000, and wherein modification allows the fill yarns to be woven around the warp yarns to form weave-crimps, without imparting crimp to the warp yarns.

32. The sailcloth of claim 1, wherein the warp yarn further comprises a textured yarn.

33. The sailcloth of claim 1, wherein the fill yarn further comprises a flat filament yarn.

34. The sailcloth of claim 1, wherein the fill yarn is crimped in the sailcloth such that texture of the textured yarn is straightened in the sailcloth.

35. The method of claim 16, wherein the fill yarn is crimped in the woven sailcloth such that texture of the textured yarn is straightened in the sailcloth.

36. The sailcloth of claim 1, wherein the textured yarn has been modified so that the filaments do not lie substantially parallel to one another.

37. The sailcloth of claim 36, wherein the majority of yarn of the warp yarn is flat filament yarn, and the majority of yarn of the fill yarn is textured yarn.

38. The sailcloth of claim 36, wherein the fill yarn comprises at least one of textured polyester yarn, textured polypropylene yarn, textured polyester-blend yarn, and textured nylon yarn; and wherein the warp yarn comprises at least one of flat-filament polyester yarn, flat-filament aramid yarn, flat-filament carbon yarn, flat-filament polyethylene yarn, flat-filament nylon yarn, and flat-filament polypropylene yarn.

39. The sailcloth of claim 36, wherein the fill yarn comprises textured polyester yarns having a denier from about 30 to about 1000, and wherein the warp yarn comprises flat-filament polyester yarn having a denier from about 100 to about 2000.

* * * * *

UNITED STATES PATENT AND TRADEMARK OFFICE

CERTIFICATE OF CORRECTION

PATENT NO. : 7,886,777 B2
APPLICATION NO. : 12/277183
DATED : February 15, 2011
INVENTOR(S) : Brian Patrick Doyle It is certified that error appears in the above-identified patent and that said Letters Patent is hereby corrected as shown below:

On the Title Page, Item (57) the abstract should be replaced with the following:

--A woven cloth is provided in which warp yarns are uncrimped. The cloth may include flat filament warp yarns and textured fill yarns. The woven cloth may be a sailcloth.--.

In the patent, column 4, line 43, “seizing” should be --sizing--.

In the patent, column 5, line 3, “method” should be --methods--.

Signed and Sealed this
Tenth Day of May, 2011

David J. Kappos

David J. Kappos
*Director of the United States Patent and Trademark Office*